United States Patent [19]

Christian

[11] 4,408,944

[45] Oct. 11, 1983

[54] CONVEYOR FOR REMOVAL OF BED DRAIN MATERIAL FROM A COAL-BURNING FLUIDIZED BED COMBUSTOR

[75] Inventor: Robert F. Christian, San Francisco, Calif.

[73] Assignee: Jude Engineering, Inc., San Francisco, Calif.

[21] Appl. No.: 204,784

[22] Filed: Nov. 7, 1980

[51] Int. Cl.[3] ..... F23J 1/02

[52] U.S. Cl. ..... 414/216; 110/165 R; 198/672; 165/87; 414/213

[58] Field of Search ..... 414/213, 216; 432/235, 432/77; 110/165 R, 110; 198/952, 661, 672, 601, 608; 165/87

[56] References Cited

U.S. PATENT DOCUMENTS

| | | | |
|---|---|---|---|
| 902,850 | 11/1908 | Auchu | 198/952 X |
| 2,250,114 | 7/1941 | Lower | 110/165 R X |
| 2,250,181 | 7/1941 | Crocker | 110/165 R X |
| 2,946,572 | 7/1960 | Annis | 110/110 X |
| 3,508,683 | 4/1970 | Van Der Schee | 198/661 X |

*Primary Examiner*—Bruce H. Stoner, Jr.

*Attorney, Agent, or Firm*—Murray & Whisenhunt

[57] ABSTRACT

The invention provides a conveyer for receiving bed drain material from a coal-burning fluid bed combuster and consists of a jacketed water cooled casing in which is a helical flight for conveying said material, the flight being mounted on an outer tube which is supported by a bearing at one end only in cantilever fashion with its other end within the closed end of the water cooled tube, an inner water cooling tube being located within the outer tube for water to circulate through the inner tube and back through the outer tube.

2 Claims, 4 Drawing Figures

CONVEYOR FOR REMOVAL OF BED DRAIN MATERIAL FROM A COAL-BURNING FLUIDIZED BED COMBUSTOR

BACKGROUND OF THE INVENTION

This invention relates to conveyer apparatus for receiving ash known as bed drain material which gravitates from the bottom of coal-burning fluid bed combuster furnaces and conveying it to a receiving station. The bed drain material is received with some compressed air and it is desirable to avoid this compressed air reaching the outlet of the conveyer apparatus.

GENERAL DESCRIPTION OF THE INVENTION

According to this invention we provide apparatus for conveying bed drain material from a fluidised bed combuster comprising a non-rotary cylindrical jacketed casing, means for transporting cooling water along the jacket space, a plurality of inlet openings in said casing spaced apart along the casing, an outer water cooling tube for cooling water located in the casing, a helically wound flight secured to the tube between it and the casing, said flight having lengths of increasing pitch from the inlet end to near the outlet end, a tubular bearing member attached at one end to the inlet end of the water cooling tube, bearing means to support the bearing member in cantilever manner, the water cooling tube being free from supporting means within the casing, the outlet end of said water cooling tube being within the casing and spaced from the outlet end of the casing, an inner water cooling tube extending through said bearing member and outer water cooling tube, closure means for closing the outlet end of the outer water cooling tube, at least one opening in the outlet end of the inner water cooling tube whereby water can flow through the inner tube, and flow back to the inlet tube between the inner and outer water tubes.

Also according to this invention we provide apparatus for conveying bed drain material from a plurality of supply sources comprising a plurality of said conveying apparatus located parallel to each other and a gathering conveyer located transversely across the outlet ends of said plurality of conveying apparatus, said gathering conveyer comprising a jacket casing having inlet openings connected respectively with the outlet ends of said conveyer apparatus, means for conveying cooling water through the jacket space of the gathering conveyer jacket, an outer cooling water tube in said gathering conveyer casing, a helical flight fixed on said latter water tube, an inner water cooling tube in said outer water cooling tube, a discharge opening in said casing for said material, said gathering conveyer outer tube extending out of the casing at both ends, two bearing means supporting opposite ends of the gathering conveyer outer water cooling tube, said gathering conveyer inner water tube extending out of the outer water tube at both ends, and inlet and outlet openings respectively at the exposed opposite ends of the gathering conveyer inner water tube.

The material is progressively conveyed and compacted towards the outlet end of the casings where it forms a bed of material which militates against passage of compressed air.

BRIEF DESCRIPTION OF THE DRAWINGS

The invention will be further described by way of example with reference to the accompanying drawings wherein.

DETAILED DESCRIPTION OF THE INVENTION

Figure 1:
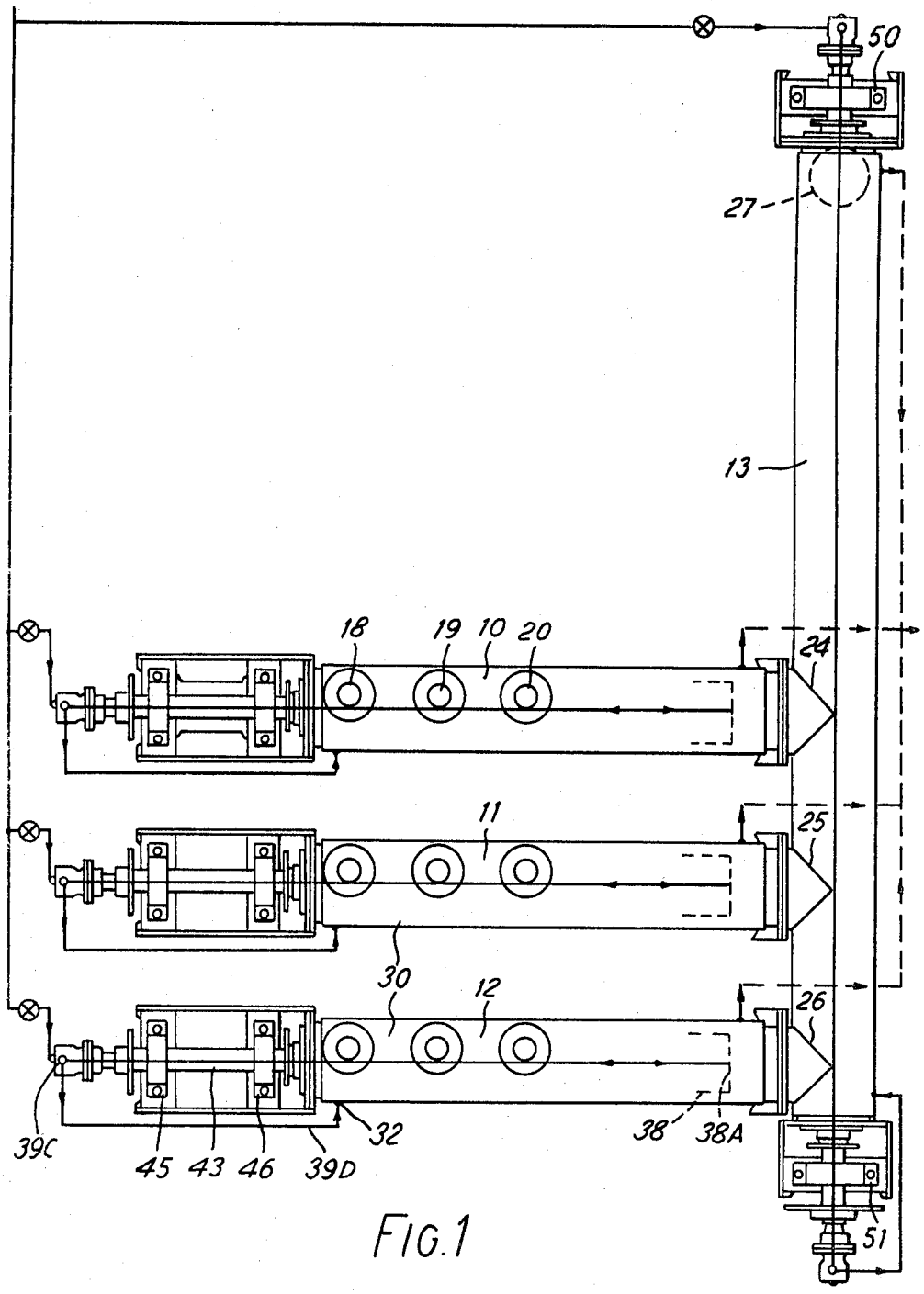
FIG. 1 is a plan view of a conveyer apparatus made in accordance with the invention.

The conveyer consists of three receiver conveyers 10, 11, 12 mounted parallel to each other and connected to a common gathering conveyer 13.

Each of the receiver conveyers has three top openings 18,19,20 into which the bed drain material gravitates in the presence of the compressed air of the fluidised beds. The top openings are suitably spaced apart along the first half of each receiver conveyor leaving a further length in which material becomes sufficiently densified to militate against escape of air. Similarly the gathering conveyer has side openings 24, 25, 26 connected with the discharge ends of the receiver conveyers and spaced along the first part of the gathering conveyer leaving a further length at the outlet end in which material is further densified so that little or no air will reach the discharge opening 27.

Figure 2:
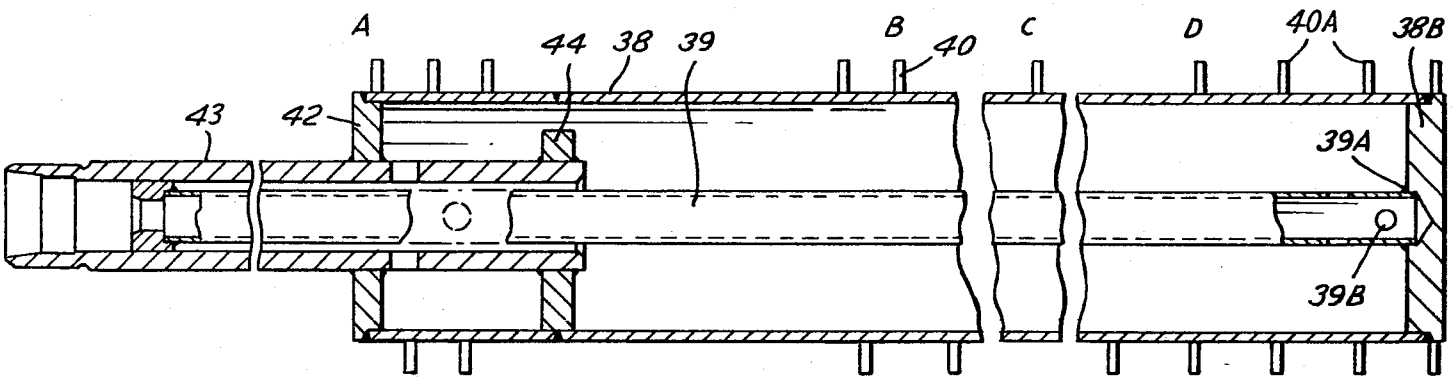
FIGS. 2 and 3 are sectional views of parts of the conveyer.
Figure 3:
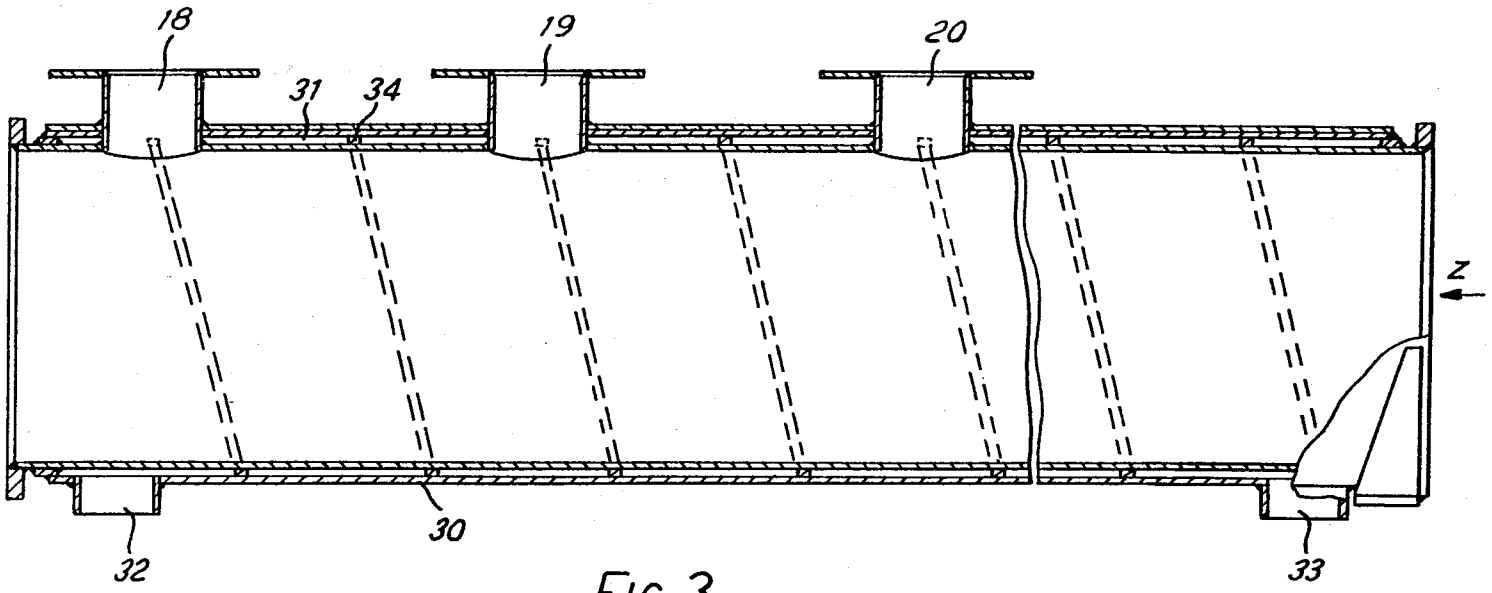
Figure 3:
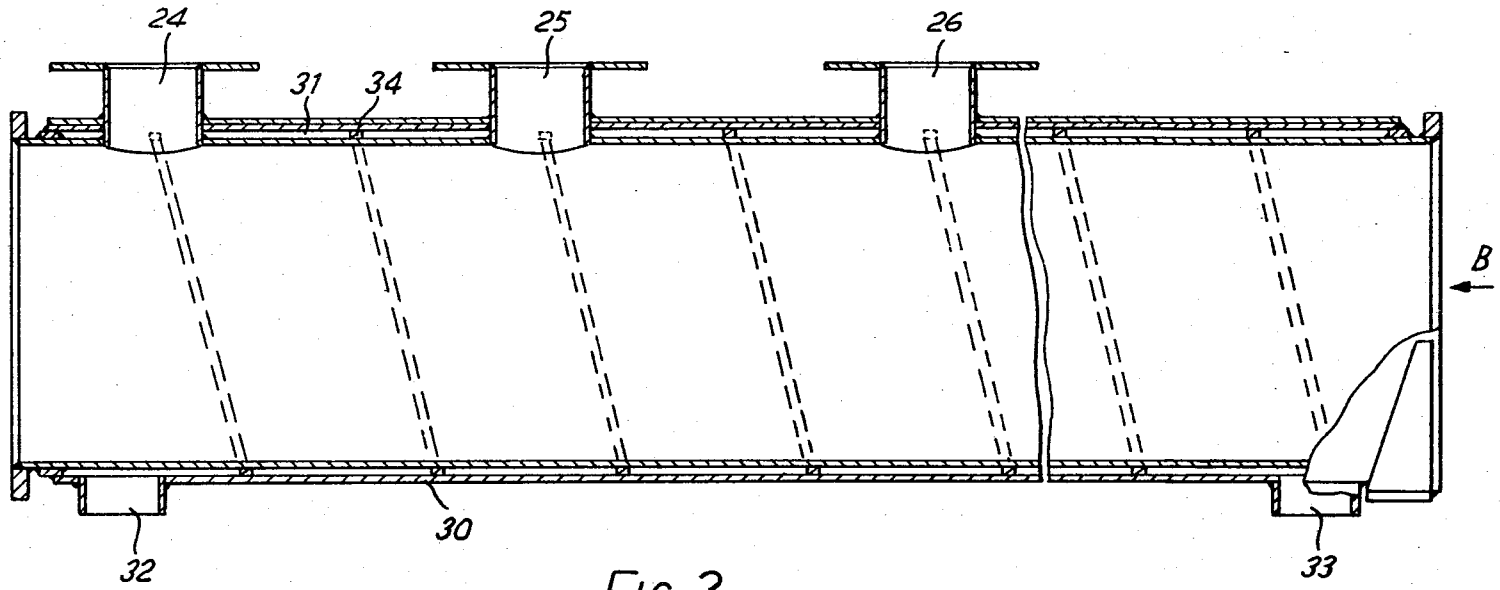
Figure 4:
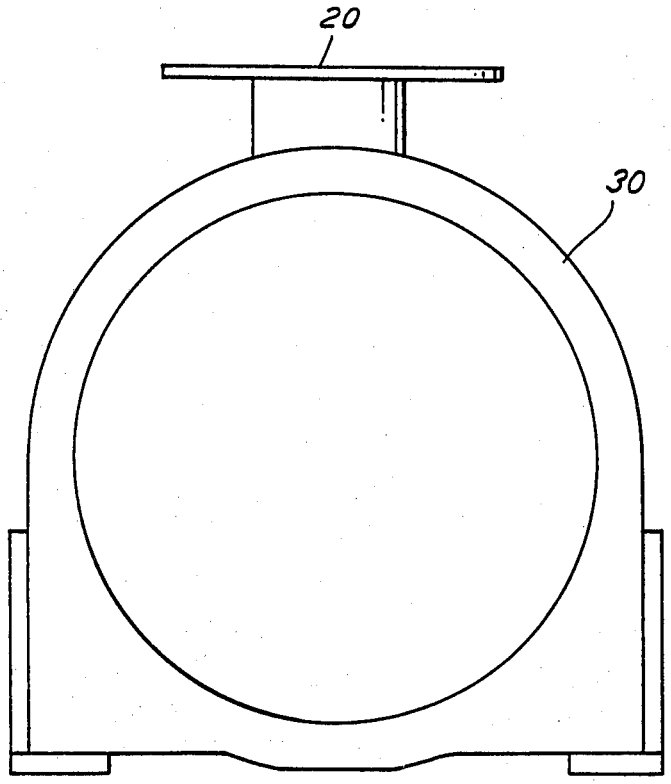
FIG. 4 is and end view in the direction of the arrow Z on FIG. 3.

Each receiver conveyer comprises a jacketed casing 30 (FIG. 3) in which is located a rotary helical flight device (FIG. 2). The casing 30 has a water space 31 with inlet 32 and outlet 33. In the space 31 there is a helical flight 34 to convey the water along the space.

The rotary device (FIG. 2) comprises an outer water carrying tube 38 within which is an inner water carrying tube 39. The outer tube 38 is spaced from the casing 30 to provide a hollow cylindrical space to contain the bed drain material and within this space there is a helical conveyer flight 40 welded to the tube 38. This flight has stepwise progressively increasing pitch from the inlet end to near the outlet end viz. from A to B may be 2 inch pitch, from B to C may be 4 inch pitch and from C to D may be 6 inch pitch, these parts of different pitch being also progressively longer towards the outlet end. At the outlet end the flight has several turns 40A of shorter pitch to assist in densifying the material at that end.

The outer tube 38 has an end plate 42 at the inlet end through which projects a bearing tube 43 which is welded to 42. The inner end of the bearing tube 43 is also supported by a bracket 44. The bearing tube 43 is mounted in two bearings 45, 46 (FIG. 1) spaced apart so as to support the tube 38 in cantilever fashion within the casing 30, the end 38A of the tube 38 being spaced from the end of the casing 30 and being closed by an end plate 38B.

The inner water carrying tube 39 has its outlet end welded at 39A to the plate 38B and has outlet holes 39B at that end. The other end of the tube 39 passes through the bearing tube 43 and projects out of the tube 38 where it has a water connection 39C connected by pipe 39D with the water inlet 32 of the casing 30.

The three receiver conveyers discharge into the side openings 24, 25, 26 of the gathering conveyer 13 which is disposed transversely across the ends of the receiver conveyers. The gathering conveyer is of almost identical design to the receiver conveyers except that it is longer to receive the material discharged from the three receiver conveyers and driven at a faster speed and the outer water carrying tube in this case is mounted in two bearings 50, 51 at opposite ends of the conveyer; this being possible because of the discharge opening 27 opens downwardly instead of axially as with the receiver conveyers.

The level of ash in the combuster can be controlled by adjusting the speed of the conveyers.

I claim:

1. Apparatus for conveying bed drain material from a fluidised bed combuster comprising:

(1) a helical gathering conveyer (13), (2) a plurality of helical receiver conveyers (10,11,12) parallel to each other and at right angles to the gathering conveyer and having their discharge ends connected to and discharging into the gathering conveyer, (3) said discharge ends of the receiver conveyers being spaced from the discharge end of the gathering conveyer a sufficient distance to ensure densifying of the bed drain material adequate to prevent blow through of the material under pressure from the combuster, (4) a plurality of entry openings (18,19,20) in each receiver conveyer to receive said bed drain material, (5) said entry openings (18,19,20) being spaced a sufficient distance from the discharge ends of the receiver conveyers to enable the material to be densified adequately to prevent blow through of the material under pressure from the combuster.

each of said receiver conveyers comprising:

(a) a non-rotary double walled cylindrical casing (30) having a jacket space between its walls, (b) exit and entry means (32,33) for circulating water through the jacket space, (c) a first water carrying tube (38) located rotatably within the casing, (d) said first water carrying tube (38) having a helical conveyer flight on its outer surface located between it and said casing (30), (e) said flight having a progressively longer pitch from its inlet end to near its outlet end, (f) said flight having a closer pitch (40A) near its discharge end than the pitch (40) immediately preceding said discharge end, (g) a second water carrying tube (39) located within the first water carrying tube (38) and extending through said first water carrying tube and extending out of one end of said first water carrying tube, (h) an opening (39B) in said second water carrying tube (39) connecting the interior of the second water carrying tube with the interior of the first water carrying tube (38), (i) means (39D) connecting the second water carrying tube to said entry means (32) to said jacket space in the casing (30), (j) a bearing tube (43) having an inner end extending a short distance into the first water carrying tube and its other end projecting out of said first water carrying tube and surrounding the second water carrying tube both within and outside of the first water carrying tube and spaced radially from the second water carrying tube to provide a space for exit of water from the interior of the first water carrying tube (38).

2. Apparatus as claimed in claim 1 wherein each receiver conveyer has:

(i) two end walls (42,38B) through one end wall of which (42) the bearing tube (43) extends, said bearing tube being welded to said one end wall, (ii) a bearing plate (44) within said first water carrying tube fixed to and supporting the inner end of the bearing tube (43), (iii) said second water carrying tube (39) having one end fixed to the other of said two end walls (38B) and its other end supported within and by said bearing tube (43), (iv) a plurality of bearings (45,46) supporting said bearing tube (43) outside said first water carrying tube (38) so as to support the first water carrying tube (38) within the casing (30) in cantilever fashion, said first water carrying tube being free from bearing support within said casing.

* * * * *